United States Patent [19]

Davenport et al.

[11] 4,397,698

[45] Aug. 9, 1983

[54] METHOD OF MAKING AS-HOT-ROLLED PLATE

[75] Inventors: Anthony T. Davenport, Shaker Heights; David W. Dickinson, Hinkley; Daniel R. DiMicco, Stow, all of Ohio

[73] Assignee: Republic Steel Corporation, Cleveland, Ohio

[21] Appl. No.: 302,228

[22] Filed: Sep. 14, 1981

Related U.S. Application Data

[63] Continuation-in-part of Ser. No. 91,770, Nov. 6, 1979, abandoned.

[51] Int. Cl.[3] ..... C21D 8/02

[52] U.S. Cl. ..... 148/12 F; 148/12.4

[58] Field of Search ..... 148/12 F, 12.4, 36; 75/123 J

[56] References Cited

U.S. PATENT DOCUMENTS

| | | | |
|---|---|---|---|
| Re. 28,878 | 6/1976 | Korchynsky et al. | 75/123 E |
| 3,173,782 | 3/1965 | Melloy et al. | 75/123 |
| 3,562,028 | 2/1971 | Heitmann et al. | 148/36 |
| 3,661,537 | 5/1972 | Aronson et al. | 75/123 J |
| 3,666,452 | 5/1972 | Korchynsky et al. | 75/123 E |
| 3,666,570 | 5/1972 | Korchynsky et al. | 148/36 |
| 3,725,049 | 4/1973 | Satoh | 75/123 D |
| 3,826,691 | 7/1974 | Melloy et al. | 148/12 F |
| 3,918,999 | 11/1975 | Sekine et al. | 148/12 F |
| 3,976,514 | 8/1976 | Matsukura et al. | 148/12 F |
| 3,982,969 | 9/1976 | Koros et al. | 148/12 F |
| 3,997,372 | 12/1976 | Matas et al. | 148/36 |
| 4,008,103 | 2/1977 | Miyoshi et al. | 148/12 F |
| 4,137,104 | 1/1979 | Nashiwa et al. | 148/36 |

FOREIGN PATENT DOCUMENTS

| | | | |
|---|---|---|---|
| 47-506 | 1/1972 | Japan | 148/12 F |

OTHER PUBLICATIONS

Klausting et al., "Development of High Tensile Strength Steel for Building Construction".

Irvine et al., "Grain-Refined C-$M_n$ Steels", Journal of Iron and Steel Institute, Feb. 1967, pp.161-182.

Irvine et al., "Low-Carbon Steels with Ferrite-Pearlite Structures", Journal of Iron and Steel Institute, Nov. 1963, pp. 944-959.

Metals Handbook, 9th Edition, vol. 1, "Properties and Selection: Irons and Steels", 1978, pp. 188 and 189.

Grozier, "Production of Microalloyed Strip and Plate by Controlled Cooling", MicroAlloying 75, Session 2A, Wash., DC, Oct. 1-3, 1975, pp. 23-32.

Greday, "The Combined Effect of Microalloying Steels with Columbium and Vanadium", MicroAlloying 75, Session I, Wash., DC, Oct. 1-3, 1975, pp. 145-158.

*Primary Examiner*—Peter K. Skiff

*Attorney, Agent, or Firm*—Watts, Hoffmann, Fisher & Heinke

[57] ABSTRACT

A new precipitation hardened, high strength plate product has been developed that attains 80 ksi minimum strength together with excellent toughness, high formability and weldability without heat treatment or the need to cool at rates faster than air cooling. The optimum mechanical properties are achieved by a critical balance of carbon in the range of from 0.20-0.26%, manganese in the range of from 1.0-1.7%, vanadium in the range of from 0.08-0.20%, and at least one of from 0.01 to 0.025 nitrogen and from 0.01 to 0.10 columbium, processing the steel to obtain interphase precipitation strengthening, and by a controlled rolling procedure in which there is no substantial rolling below the $Ar_3$ temperature.

2 Claims, No Drawings

METHOD OF MAKING AS-HOT-ROLLED PLATE

RELATED APPLICATIONS

This application is a continuation-in-part of Ser. No. 091,770, filed Nov. 6, 1979, now abandoned.

BACKGROUND OF THE INVENTION

The present invention relates generally to the production of steel plate for structural applications, and more specifically to the manufacture of as-hot-rolled, high strength, low alloy steel plate which, in the as-hot-rolled condition, is characterized by a high yield strength of at least 80 ksi and by a combination of excellent toughness, formability and weldability.

The development of as-hot-rolled plate steels as alternatives to more expensive heat treated steels for structural applications has been of long-standing interest to the steel industry. This interest has been heightened by the increasing costs of energy required in heat treatment operations. Progress has been made in the development of tough, weldable, microalloyed controlled-rolled plate products as substitutes for normalized steels in applications requiring yield strengths that do not exceed about 70 ksi. Less progress has been made in providing as-rolled plate for higher strength applications, e.g. applications requiring yield strengths in excess of 80 ksi where quenched and tempered steels now predominate.

The reasons for this are largely attributable to the severe metallurgical restraints in achieving high strength by air cooling directly off the plate mill while meeting the weldability, toughness and formability requirements essential for structural applications. Factors which are known to be important in controlling the strength, weldability, toughness and formability of structural steel plate include a ferrite-pearlite microstructure, the proportion of pearlite in the microstructure, grain refinement, precipitation hardening by carbides and nitrides, and a restricted carbon equivalence. These factors often conflict with each other or act at cross-purposes. For example, when the carbon content is maintained at low levels below about 0.2% in order to promote weldability, formability and and impact properties, it may not be possible to achieve an 80 ksi yield strength even when the steel is microalloyed with columbium and/or vanadium. As the carbon equivalence level is increased to improve the strength, the toughness, weldability and formability are reduced. Controlled-rolling, while known to be beneficial from the standpoints of ferrite-grain refinement and consequent toughness and formability, tends to raise the $Ar_3$ temperature and adversely affect vanadium-columbium strengthening.

The ability of low carbon ferrite-pearlite steels microalloyed with columbium and/or vanadium to meet 70 ksi minimum yield strength requirements with good toughness and weldability has been established on a commercial basis. Their production emphasizes controlled rolling for grain refinement together with low carbon levels for improved impact properties and weldability. A major difficulty arises in achieving 80 ksi yield strengths in air cooled, low carbon ferrite-pearlite steels because of the limitations in the precipitation hardening potential of vanadium and columbium. The strengthening increase produced by columbium and vanadium diminishes with increasing levels of these elements so that yield strengths of about 75 ksi are difficult to obtain despite microalloying to uneconomical levels. It is known that the major precipitation strengthening mechanism in air-cooled, ferrite-pearlite steels is largely associated with the precipitation of microalloyed carbonitrides during transformation and that the degree of precipitation strengthening is inversely related to the ferrite transformation temperature which controls the dispersion and size of the precipitates. The very factors which provide for excellent toughness, namely, low carbon content and controlled-rolling, combine to raise the ferrite transformation temperature and thereby severely limit the degree to which precipitation strengthening is obtained.

In attempting to achieve high strength combined with good toughness, formability and weldability, it has been proposed to use an aluminum-killed steel containing 0.02–0.26% carbon, 1.25–1.75% manganese, 0.75–1.5% silicon, 0.003–0.015% nitrogen, 0–0.07% vanadium, and 0–0.03% columbium, and to subject the steel to a hot rolling finishing operation in which there is at least a 25% hot rolling deformation above the $A_1$ temperature. In this procedure, the controlled-rolling is mainly for the purpose of grain refinement. With carbon contents ranging from about 0.18–0.26%, it was suggested that the finishing operation could be carried out in the two-phase region in which the microstructure is both austenite and ferrite. It was also suggested that the cooling procedure can be conducted in still air or with a water spray or with air impingement. The yield strengths attributed to higher carbon level steels (0.18–0.26%) processed in the manner described range from 70 to 85 ksi. The optional use of columbium and vanadium in a maximum amount of 0.07% indicates that the microalloying strengthening mechanism is primarily due to grain refinement and that water cooling and maximum carbon content are required to achieve yield strengths in excess of 80 ksi. At the higher carbon levels required for optimum strength, careful control must be exercised when cooling by the water spray and air impingement methods in order to avoid the formation of bainite.

A related prior art practice is described in U.S. Pat. No. 4,008,103 to Miyoshi et al. The process is characterized by low temperature austenitization, e.g., 800° to 950° C., followed by fishing rolling in the two-phase or alpha-gamma region well below the $Ar_3$ temperature. Intercritical rolling is an essential feature of the invention and is necessary to achieve minimum yield strengths of 80 ksi.

Although rolling in the two phase region can produce yield strengths in excess of 80 ksi, this approach has significant disadvantages. The finishing requirements are severe and are beyond the practical operating limitations of some commercial mills. Other drawbacks include high mill loads, long rolling times, and shape and flatness control problems. Rolling in the two phase region also can produce properties which are anisotropic in the plane of the plate so that it may delaminate or split. In addition, the Charpy V-notch impact properties in the plane of the plate may be adversely affected.

An alternative prior art approach uses a killed low-alloy steel containing 0.12–0.20% carbon, 1.10–1.65% manganese, 0.05–0.20 vanadium, 0.005–0.025% nitrogen and 0.60% maximum silicon. In order to possess the desired properties of good toughness, weldability and formability combined with a yield strength in excess of 80 ksi, this steel is hot finished in a temperature range of 1550°–1650° F., cooled at a rate of from 20°–135° F. per second, and collected, as by coiling or piling, within a temperature range of from 1025°–1175° F. The steel must be water quenched to achieve the cooling rate that is necessary to obtain yield strengths of at least 80 ksi and must be collected above a minimum temperature (1025° F.) to avoid the formation of lower transformation products, e.g., bainite, in the microstructure.

SUMMARY OF THE INVENTION

The purpose of this invention is to provide a plate product which exhibits a high yield strength of at least 80 ksi combined with excellent toughness, formability, and weldability in the as-hot-rolled condition.

It has been found that it is possible to achieve the desired combination of mechanical properties essential for structural applications in a high-strength, low-alloy, as-hot-rolled plate product through a careful balance of chemical composition and controlled-rolling according to a precise schedule. The basic composition contemplated by the invention contains carbon, manganese, vanadium, and nitrogen and/or columbium. The composition is critically balanced to optimize precipitation strengthening of vanadium carbonitrides and/or vanadium carbides, and to minimize carbon equivalence for good weldability and toughness. Desulfurization and sulfide shape control are desirable features in the production of the new product in order to contribute to its excellent toughness and ductility. The specific combination and interrelation of composition and controlled rolling achieve a synergistic effect that is an improvement over the prior art in terms of an as-hot-rolled product having high strength coupled with excellent impact resistance or toughness, weldability, and formability. In particular, the invention makes it possible to produce a plate product which, in the as-hot-rolled condition without quenching and without significant rolling below the $Ar_3$ temperature, is characterized by a minimum yield strength of 80 ksi, 15 foot-pound Charpy V-notch impact temperatures in the range of from about −30° C. to −70° C. or lower, and a carbon equivalence of less than about 0.55. These properties are obtained in as-hot-rolled plate up to about ¾ inch in thickness without the need to cool at rates faster than air cooling.

One aspect of the invention is an as-hot-rolled, killed steel plate characterized in the hot rolled condition by a precipitation hardened ferrite-pearlite microstructure, a minimum yield strength of 80 ksi and a combination of good toughness, formability and weldability, the steel plate having a composition consisting essentially in percent by weight of 0.20–0.26 carbon, 1.0–1.7 manganese, 0.08–0.20 vanadium, 0–0.2 sulfide shape control agent, up to about 1.5 silicon, up to about 0.04 phosphorous, up to about 0.02 sulfur, at least one of from 0.01 to 0.025 nitrogen and from 0.01 to 0.10 columbium, 0–1.5 copper, 0–0.09 aluminum, and the balance iron.

Another aspect of the invention consists of a process of making as-hot-rolled steel plate characterized in the hot-rolled condition by a precipitation hardened ferrite-pearlite microstructure, a minimum yield strength of 80 ksi and a combination of good toughness, high formability and weldability comprising the steps of providing a killed steel consisting essentially in percent by weight of 0.20–0.26 carbon, 1.0–1.7 manganese, 0.08–0.20 vanadium, 0–0.20 sulfide shape control agent, up to about 1.5 silicon, up to about 0.04 phosphorous, up to about 0.02 sulfur, at least one of from 0.01 to 0.025 nitrogen and from 0.01 to 0.10 columbium, 0–1.5 copper, 0–0.09 aluminum and the balance iron, heating to a temperature at which sufficient vanadium is dissolved to obtain precipitation hardening with a minimum yield strength of 80 ksi, and hot rolling the steel from said temperature according to a controlled schedule such that there is no substantial rolling below the $Ar_3$ temperature.

In more specific embodiments of the invention, the new plate product and process of manufacture are characterized by an aluminum-killed steel consisting essentially in percent by weight of 0.20–0.26 carbon, 1.0–1.5 manganese, 0.10–0.60 silicon, up to 0.02 phosphorous, up to 0.015 sulfur, 0.10–0.20 vanadium, 0.01–0.03 columbium, 0.01–0.02 nitrogen, 0.01 to 0.04 rare earth, 0.20–0.50 copper, 0.01–0.09 aluminum and the balance iron; and by a rolling schedule providing a minimum of about 30% hot reduction below about 950° C. and no more than 5% reduction below the $Ar_3$ temperature.

The vanadium content and the controlled-rolling procedure are important features. The strengthening effect produced in the carbon-manganese-ferrite-pearlite steels of the invention which contain vanadium largely results from interphase precipitation strenghthening rather than grain refinement. In these steels, the minimum vanadium content necessary to assure the desired precipitation hardening and consequent yield strengths of at least 80 ksi is 0.08%, and more preferably 0.10%.

Interphase precipitation hardening, which occurs at austenite transforms to proeutectoid ferrite, requires heating to an austenitizing temperature sufficient to dissolve a substantial amount of the vanadium content. In the case of the present invention, the steels are heated to a preferred austenitizing temperature of at least about 1200° C. During the initial stages of ferrite formation, the rejection of carbon from the ferrite causes local enrichment of the austenite-ferrite interphase boundary; this, in turn, stimulates the precipitation of fine particles of vanadium carbide on the interphase boundary. These carbides grow and absorb carbon to an extent that ferrite can continue to grow. At a later stage, the precipitation process repeats itself when the boundary conditions are re-established. The process results in a periodic array of vanadium carbides being left behind in the ferrite as the interphase boundary moves through the steel. By controlling the vanadium addition and the $Ar_3$ transformation temperature so that it is low, e.g., 700° C. to less than 760° C., the carbide dispersions can be made fine enough to cause significant hardening.

The controlled-rolling schedule specified as an essential feature of the invention achieves an unexpected improvement in impact properties or toughness and is also important to good formability. While controlled rolling has been recognized by others as producing ferrite-grain refinement, the unexpected improvement in toughness or impact properties characterizing the plate product of the invention is believed to be the result of a substantial reduction in pearlite content. This is accomplished by a hot-rolling reduction of at least 30% below about 950° C. In accordance with the invention, the controlled-rolling is carried out so that there is not more than a 5% reduction below the $Ar_3$ temperature or in the two-phase region in which the microstructure is both austenite and ferrite. In the case of the steel compositions of the invention, the $Ar_3$ temperature is adjusted to be in a range of from about 700° C. to 760° C.

Additional advantages and a fuller understanding of the invention will be had from the following detailed description.

DESCRIPTION OF THE PREFERRED EMBODIMENTS

The improved as-hot-rolled plate of the invention is a carbon-manganese-ferrite-pearlite steel which is alloyed with vanadium and processed to achieve high strength (80 ksi minimum yield) and controlled rolled to a precise schedule for toughness. The 80 ksi yield strength is obtained by a critical balance of composition and by precipitation hardening. In accordance with the present invention, the carbon and manganese are increased to levels necessary to attain the desired yield strength, and yet are controlled to prevent the formation of bainite and martensitic products known to be detrimental to ductility and toughness and to keep the carbon equivalence within the limits necessary for good weldability.

The carbon content may range from about 0.20 to 0.26% and the manganese from about 1.0 to 1.7% with the preferred upper limit being about 1.5%. Manganese in excess of 1.5% may cause a deterioration of yield strength and impact properties as a result of the formation of secondary bainite. It will be understood by those working in the art that nickel can be substituted for part of the manganese according to the ratio of about two to three parts nickel for one part manganese. As used herein, the term "manganese" means manganese alone as well as its equivalent in terms of nickel substituted according to the foregoing ratio.

Optimum welding properties are promoted by minimizing the carbon equivalence as determined by formula $$C.E. = \frac{Mn}{6} + \frac{Cr + Mo + V}{5} + \frac{Ni + Cu}{15}$$

On the basis of carbon equivalence, it has been found that the vanadium alloyed, carbon-manganese-ferrite-pearlite steels of the invention offer better welding performance than bainitic steels of equivalent yield strength. The steels of this invention display minimum yield strengths of 80 ksi with a carbon equivalence of about 0.45 to 0.55, while a higher carbon equivalence of 0.55 to 0.60 or higher is required for bainitic steels to provide the same minimum strength level.

The substantial strengthening effect of vanadium largely results from precipitation strengthening and a critical minimum level is required to achieve the desired high strengths in an as-hot-rolled product. The importance of the vanadium content on strength is demonstrated in Table I.

TABLE I

| Steel | C | Mn | Si | V | Cb | N | Al | Yield Strength ksi |
|---|---|---|---|---|---|---|---|---|
| A | .20 | 1.51 | 0.23 | — | — | 0.016 | 0.020 | 62.7 |
| B | .23 | 1.35 | 0.09 | 0.07 | 0.014 | 0.004 | 0.032 | 76.0 |
| C | .24 | 1.33 | 0.027 | 0.09 | 0.015 | 0.016 | 0.010 | 80.0 |
| D | .21 | 1.38 | 0.14 | 0.10 | 0.075 | 0.016 | 0.028 | 78.0 |
| E | .22 | 1.53 | 0.19 | 0.10 | — | 0.016 | 0.024 | 83.0 |
| F | .22 | 1.50 | 0.25 | 0.12 | — | 0.013 | 0.045 | 81.5 |
| G | .23 | 1.56 | 0.26 | 0.15 | 0.029 | 0.017 | 0.062 | 84.5 |
| H | .20 | 1.44 | 0.23 | 0.20 | — | 0.016 | 0.017 | 80.5 |
| I | .21 | 1.41 | 0.22 | 0.20 | 0.092 | 0.016 | 0.026 | 82.0 |
| J | .23 | 1.50 | 0.24 | 0.21 | — | 0.015 | 0.040 | 86.5 |
| K | .23 | 1.54 | 0.26 | 0.19 | 0.029 | 0.018 | 0.062 | 86.8 |
| L | .20 | 1.43 | 0.25 | 0.16 | — | 0.016 | 0.025 | 82.0 |

It will be seen from Table I that the minimum vanadium level must be 0.08% or 0.09%, and that the optimum minimum level to assure consistent yield strengths of at least 80 ksi is 0.10%. Amounts of vanadium in excess of about 0.20% do not produce significant increased strengthening and are considered uneconomic.

Some small but reliable increase in precipitation strengthening can be obtained with nitrogen in amounts of from about 0.01 to 0.025%. Columbium does not appear to have a significant beneficial effect on toughness; however, small additions up to 0.10%, and more preferably from 0.01 to 0.03%, have been found to increase the controlled-rolled yield strength by 3 to 5 ksi under conditions of low nitrogen content, i.e., 0.010% or less, and also may be included in the composition. In order to assure minimum yield strengths of 80 ksi with minimum carbon and alloy content, the composition should include either nitrogen or columbium in the ranges specified.

The importance of nitrogen and columbium to achieving yield strengths of at least 80 ksi in as-hot-rolled steel plate is demonstrated by the following Table II. The steels reported in this table were subjected to a controlled rolling process consisting of austenitizing at about 1288° C. and forming to one-half inch thick plate by rolling to about 815° C. finish temperature. The $Ar_3$ temperature of the reported steels was less than about 760° C. so that there was no intercritical rolling, i.e., rolling in the two-phase region of ferrite and austenite. Heat E280 contained 0.016 nitrogen and had a yield strength of 82.1 ksi, while heat F105 containing 0.002 nitrogen which is less than the required minimum of 0.01 had a yield strength of only 68.9 ksi. Heat F106 also contained less than the required minimum amount of nitrogen and had a yield strength of 75.4 ksi despite a vanadium content of 0.17. In contrast, heat E593 achieved a yield strength of 81.4 ksi with a nitrogen content of 0.013 and a vanadium content of only 0.12. Heat F109 shows the criticality of columbium in steels containing less than the required minimum of nitrogen. This heat had a yield strength of 80.7 ksi, whereas heat F106 containing the same amount of nitrogen (0.003) and no columbium had a yield strength of only 75.4 ksi.

TABLE II

| Heat No. | C | Mn | Si | Al | V | N | Cb | YS (ksi) | UTS (ksi) |
|---|---|---|---|---|---|---|---|---|---|
| F105 | .21 | 1.50 | .28 | .04 | .11 | .002 | | 68.9 | 93.5 |
| E280 | .22 | 1.50 | .19 | .02 | .10 | .016 | | 82.1 | 101.25 |
| F106 | .20 | 1.4 | .27 | .03 | .17 | .003 | | 75.4 | 100.1 |
| F109 | .20 | 1.5 | .278 | .03 | .16 | .003 | .02 | 80.7 | 106.0 |
| E593 | .22 | 1.5 | .25 | .05 | .12 | .013 | | 81.4 | 102.4 |

When optimum formability is desired, the practice of the invention may include desulfurization and sulfide shape control. The addition of a sulfide shape control agent is especially desired in compositions containing more than about 0.003% sulfur. Sulfide inclusions that are unavoidably or even for some purposes desirably present, notably manganese sulfides, usually appear as globular or oval in shape before hot rolling. After hot rolling, the sulfides tend to be abnormally elongated in the rolling direction. This adversely affects the transverse ductility and toughness properties of the product. By addition, however, of certain shape control agents (which presumably reduce the plasticity of the inclusions), the sulfides can be kept in oval configuration, with corresponding preservation of ductility and toughness properties in transverse as well as longitudinal directions. This shape control agent, conventionally so designated, although it may in fact be plural, can be one or more elements selected from the group consisting of the rare earth metals (e.g., cerium, lanthanum, etc. or misch-metal which is a mixture of rare earths) calcium, zirconium, titanium and in some cases selenium or tellurium. The function of such agents is well known.

The amount of sulfide shape control agent may range up to about 0.2% depending upon the specific materials which are selected from the group mentioned above and the particular composition of the steel, as will be recognized by those working in the art. In a preferred practice of the invention, sulfide shape control is carried out by a ladle or mold addition of misch-metal in an amount calculated to provide a cerium content of about 0.01 to 0.04%, and more preferably of from 0.01 to 0.02%.

The silicon content of the steel must be carefully controlled in relation to the controlled rolling schedule to provide the desired balance of physical properties. While silicon has the beneficial effect of improving the yield strength of the steel by about 12 ksi for each 1% increase in content, it has the disadvantages of adversely affecting impact properties and increasing the hot strength of the gamma phase which makes the steel more difficult to roll. Taking into account these factors, the preferred silicon content is limited to 0.60% with an optimum range being 0.10 to 0.40%. When there is adequate controlled-rolling to offset the detrimental effect of silicon, such as by rolling to a schedule providing for at least 70% hot reduction below about 950° C., silicon contents up to about 1.5% may be used.

The atmospheric corrosion resistance of the steel is about equal to that of ordinary mild steel. In applications where better corrosion resistance is desired, copper may be added to the composition in an amount up to about 0.50% with the preferred minimum being about 0.20%. An addition of copper in the range specified results in atmospheric corrosion resistance about twice that of mild steel. Atmospheric corrosion resistance greater than this may be obtained by adding increased copper up to about 1.5% together with sufficient nickel to prevent hot shortness. According to recognized practice, amounts of copper in excess of about 0.50% should be accompanied by nickel contents of one-half to one times the total copper content. Any nickel that is added should be substituted for manganese according to the manganese-nickel ratio previously discussed.

A critical feature in the practice of the invention is a controlled-rolling operation. Optimum impact properties of 15 foot-pound Charpy V-notch impact temperatures of about −30° C. to −70° C. or lower are obtained by controlled-rolling between about 950° C. and the $Ar_3$ temperature. The unexpected improvement in toughness or impact properties characterizing the invention is believed to be largely due to a substantial reduction in pearlite content rather than grain refinement.

In order to achieve the desired properties, the process of the invention requires heating to an austenitizing temperature at which sufficient vanadium is dissolved to obtain a precipitation hardened microstructure with a minimum yield strength of 80 ksi. The preferred austenitizing temperature is at least 1200° C. The steel is then controlled rolled so that there is no substantial rolling below the $Ar_3$ temperature. A preferred rolling schedule consists of at least a 30% reduction of thickness below about 950° C. and no more than 5% reduction below the $Ar_3$ temperature.

The advantages and the practice of the invention is further demonstrated by the following specific examples.

Plate samples were rolled from eight ingots made from a desulfurized and aluminum-killed heat of steel. The ingots were treated in the mold with misch-metal for sulfide shape control. The chemistries of the plate samples are listed in Table III.

Table IV lists the plate thicknesses, the rolling procedure and the finishing temperatures. The toughness parameters, yield and tensile strengths, and percent elongation in 8 inches are reported in Table IV. In Table V the designation FATT will be understood to refer to fraction-appearance-transition-temperature conventionally used in the Charpy V-notch tests to describe the temperature at which the fracture is 50% ductile.

The importance of controlled-rolling in developing good toughness is apparent from the data of Table IV. With the exception of plate 6-1 which had a thickness of ¾ inch, the controlled-rolled plates consistently met a transverse impact requirement of 15 foot-pounds at −30° C., whereas the non-controlled-rolled plates could not meet this requirement. With the exception of plates 7-1 and 8-1 which had thicknesses of one inch, the controlled rolled plates of the invention met the yield strength requirement of at least 80 ksi.

TABLE III

| Plate I.D. | C | Mn | P | S | Si | Cb | V* | Al | N | O | Ce | La |
|---|---|---|---|---|---|---|---|---|---|---|---|---|
| 1-1 | 0.23 | 1.59 | 0.011 | 0.006 | 0.28 | 0.028 | 0.15 | 0.069 | 0.018 | 0.004 | 0.02 | 0.011 |
| 1-2 | 0.22 | 1.58 | 0.009 | 0.006 | 0.27 | 0.030 | 0.15 | 0.066 | 0.017 | 0.002 | 0.02 | 0.016 |
| 1-3 | 0.22 | 1.55 | 0.009 | 0.006 | 0.26 | 0.027 | 0.14 | 0.070 | 0.017 | 0.003 | N.A.+ | N.A.+ |
| 2-1 | 0.23 | 1.58 | 0.010 | 0.005 | 0.29 | 0.025 | 0.19 | 0.072 | 0.018 | 0.003 | 0.02 | 0.011 |
| 2-2 | 0.22 | 1.57 | 0.009 | 0.006 | 0.26 | 0.029 | 0.20 | 0.063 | 0.018 | 0.002 | 0.02 | 0.016 |
| 2-3 | 0.23 | 1.54 | 0.009 | 0.006 | 0.26 | 0.026 | 0.19 | 0.065 | 0.018 | 0.003 | N.A.+ | N.A.+ |
| 3-1 | 0.22 | 1.61 | 0.01 | 0.006 | 0.27 | 0.027 | 0.14 | 0.069 | 0.017 | 0.006 | 0.01 | 0.006 |
| 3-2 | 0.23 | 1.59 | 0.01 | 0.006 | 0.26 | 0.031 | 0.16 | 0.062 | 0.017 | 0.003 | 0.01 | 0.009 |
| 3-3 | 0.21 | 1.53 | 0.008 | 0.006 | 0.27 | 0.023 | 0.14 | 0.070 | 0.017 | 0.003 | 0.02 | 0.012 |
| 4-1 | 0.24 | 1.58 | 0.01 | 0.006 | 0.28 | 0.026 | 0.19 | 0.070 | 0.018 | 0.003 | 0.02 | 0.012 |
| 4-2 | 0.23 | 1.57 | 0.009 | 0.007 | 0.26 | 0.030 | 0.20 | 0.064 | 0.018 | 0.004 | 0.02 | 0.01 |
| 4-3 | 0.22 | 1.53 | 0.008 | 0.007 | 0.27 | 0.025 | 0.19 | 0.068 | 0.016 | 0.003 | 0.02 | 0.015 |
| 5-1 | 0.24 | 1.57 | 0.01 | 0.006 | 0.26 | 0.027 | 0.14 | 0.065 | 0.017 | 0.002 | 0.02 | 0.015 |
| 5-2 | 0.23 | 1.56 | 0.01 | 0.006 | 0.26 | 0.029 | 0.15 | 0.062 | 0.017 | 0.003 | 0.02 | 0.013 |
| 5-3 | 0.23 | 1.55 | 0.01 | 0.006 | 0.26 | 0.026 | 0.14 | 0.070 | 0.017 | 0.003 | N.A.+ | N.A.+ |
| 6-1 | 0.24 | 1.54 | 0.01 | 0.006 | 0.28 | 0.027 | 0.19 | 0.070 | 0.018 | 0.003 | 0.02 | 0.014 |
| 6-2 | 0.23 | 1.54 | 0.009 | 0.006 | 0.26 | 0.029 | 0.19 | 0.062 | 0.018 | 0.003 | 0.02 | 0.017 |
| 6-3 | 0.23 | 1.57 | 0.008 | 0.006 | 0.26 | 0.029 | 0.19 | 0.062 | 0.017 | 0.003 | N.A.+ | N.A.+ |
| 7-1 | 0.23 | 1.56 | 0.010 | 0.006 | 0.27 | 0.022 | 0.13 | 0.070 | 0.016 | 0.003 | 0.02 | 0.01 |
| 7-2 | 0.23 | 1.56 | 0.009 | 0.006 | 0.26 | 0.031 | 0.15 | 0.064 | 0.017 | 0.002 | 0.02 | 0.012 |

TABLE III-continued

| Plate I.D. | C | Mn | P | S | Si | Cb | V* | Al | N | O | Ce | La |
|---|---|---|---|---|---|---|---|---|---|---|---|---|
| 7-3 | 0.21 | 1.52 | 0.008 | 0.006 | 0.26 | 0.025 | 0.14 | 0.070 | 0.016 | 0.003 | 0.02 | 0.015 |
| 8-1 | 0.23 | 1.55 | 0.010 | 0.007 | 0.27 | 0.021 | 0.16 | 0.067 | 0.017 | 0.003 | 0.02 | 0.01 |
| 8-2 | 0.23 | 1.55 | 0.010 | 0.007 | 0.26 | 0.030 | 0.18 | 0.059 | 0.018 | 0.003 | 0.01 | 0.009 |
| 8-3 | 0.21 | 1.48 | 0.008 | 0.007 | 0.26 | 0.026 | 0.18 | 0.065 | 0.016 | 0.003 | 0.02 | 0.015 |

*Mold addition of Vanadium to even numbered ingots.
+Not measured.

TABLE IV

| Plate I.D. | Thickness (Inches) | Rolling Practice | Finishing Temperature (°C.) |
|---|---|---|---|
| 1-1 | ¾ | Noncontrolled | 1071 |
| 1-2 | ½ | Noncontrolled | 1010 |
| 1-3 | ¼ | Noncontrolled | 827 |
| 2-1 | ¾ | Noncontrolled | 1077 |
| 2-2 | ½ | Noncontrolled | 1010 |
| 2-3 | ¼ | Noncontrolled | 827 |
| 3-1 | 1 | Noncontrolled | 1882 |
| 3-2 | ⅝ | Noncontrolled | 1060 |
| 3-3 | ⅜ | Noncontrolled | 904 |
| 4-1 | 1 | Noncontrolled | 1093 |
| 4-2 | ⅝ | Noncontrolled | 1066 |
| 4-3 | ⅜ | Noncontrolled | 904 |

TABLE IV-continued

| Plate I.D. | Thickness (Inches) | Rolling Practice | Finishing Temperature (°C.) |
|---|---|---|---|
| 5-1 | ¾ | Controlled | 782 |
| 5-2 | ½ | Controlled | 777 |
| 5-3 | ¼ | Noncontrolled | 838 |
| 6-1 | ¾ | Controlled | 760 |
| 6-2 | ½ | Controlled | 779 |
| 6-3 | ¼ | Noncontrolled | 849 |
| 7-1 | 1 | Controlled | 849 |
| 7-2 | ⅝ | Controlled | 760 |
| 7-3 | ⅜ | Controlled | 760 |
| 8-1 | 1 | Controlled | 760 |
| 8-2 | ⅝ | Controlled | 760 |
| 8-3 | ⅜ | Controlled | 760 |

TABLE V

| Plate I.D. | Test Direction | Shelf Energy (ft-lbs) | 50% FATT (°C.) | CVN +21.1° C. (ft-lbs) | CVN −28.9° C. (ft-lbs) | Yield Strength (KSI) | Ultimate Tensile Strength (KSI) | % Elongation (8 inch) | Rolling Practice |
|---|---|---|---|---|---|---|---|---|---|
| 1-1 | L | N.D. | 99 | 7 | 4 | 89.9 | 123.9 | 14 | NCR |
| | T | N.D. | 99 | 7 | 4 | 91.2 | 125.8 | 16 | |
| 1-2 | L | N.D. | 91 | 14 | 8 | 85.5 | 117.7 | 15 | NCR |
| | T | N.D. | 82 | 19 | 6 | 86.9 | 117.5 | 19 | |
| 1-3 | L | 35 | 31 | 15 | 11 | 86.0 | 122.1 | 13 | NCR |
| | T | 30 | 29 | 14 | 8 | 89.1 | 111.1 | 14 | |
| 2-1 | L | N.D. | 99 | 6 | 4 | 88.2 | 127.6 | 14 | NCR |
| | T | N.D. | 99 | 7 | 5 | 88.3 | 120.0 | 13 | |
| 2-2 | L | N.D. | 103 | 11 | 5 | 90.2 | 121.2 | 17 | NCR |
| | T | N.D. | 91 | 17 | 6 | 90.4 | 121.3 | 16 | |
| 2-3 | L | 20 | 42 | 11 | 7 | 90.3 | 126.7 | 15 | NCR |
| | T | 28 | 37 | 11.5 | 6 | 90.2 | 127.5 | 15 | |
| 3-1 | L | N.D. | 99 | 6 | 4 | 89.6 | 127.7 | 14 | NCR |
| | T | N.D. | 99 | 6 | 4 | 91.7 | 128.7 | 15 | |
| 3-2 | L | N.D. | 99 | 8 | 5 | 87.2 | 123.3 | 16 | NCR |
| | T | N.D. | 99 | 14 | 6 | 85.7 | 118.9 | 13 | |
| 3-3 | L | 72 | 41 | 38 | 11 | 81.3 | 112.9 | 15 | NCR |
| | T | 48 | 41 | 27 | 10 | 85.4 | 111.1 | 18 | |
| 4-1 | L | N.D. | 99 | 6 | 5 | 97.5 | 134.0 | 14 | NCR |
| | T | N.D. | 99 | 4 | 4 | 94.3 | 132.8 | 14 | |
| 4-2 | L | N.D. | 99 | 6 | 4 | 84.8 | 117.2 | 15 | NCR |
| | T | N.D. | 99 | 5 | 4 | 83.4 | 112.3 | 13 | |
| 4-3 | L | N.D. | 52 | 22 | 3 | 88.2 | 120.2 | 16 | NCR |
| | T | N.D. | 73 | 14 | 8 | 89.0 | 118.1 | 17 | |
| 5-1 | L | 96 | −13 | 95 | 33 | 80.1 | 104.3 | 22 | CR |
| | T | 63 | −5 | 59 | 25 | 80.6 | 104.4 | 18 | |
| 5-2 | L | 91 | −14 | 91 | 40 | 84.7 | 107.6 | 18 | CR |
| | T | 66 | −1 | 58 | 31 | 84.3 | 101.0 | 17 | |
| 5-3 | L | 32 | +25 | 16 | 9 | 88.3 | 119.1 | 14 | NCR |
| | T | 30 | +27 | 16 | 8.5 | 90.7 | 119.5 | 15 | |
| 6-1 | L | 82 | +48 | 35 | 12 | 85.6 | 111.7 | 20 | CR |
| | T | 67 | +64 | 25 | 14 | 87.7 | 111.5 | 18 | |
| 6-2 | L | 78 | −5 | 65 | 23 | 86.8 | 109.2 | 17 | CR |
| | T | 58 | +1 | 51 | 26 | 86.4 | 111.7 | 17 | |
| 6-3 | L | 32 | +42 | 13 | 6.5 | 81.8 | 124.0 | 13 | NCR |
| | T | 25 | +29 | 11 | 7 | 92.4 | 130.0 | 15 | |
| 7-1 | L | 105 | +17 | 55 | 30 | 73.4 | 107.7 | 19 | CR |
| | T | 77 | +26 | 43 | 19 | 76.6 | 108.0 | 18 | |
| 7-2 | L | 93 | −23 | 94 | 53 | 83.8 | 104.9 | 19 | CR |
| | T | 65 | +1 | 50 | 30 | 84.1 | 106.4 | 17 | |
| 7-3 | L | 62 | −53 | 68 | 51 | 83.0 | 109.0 | 16 | CR |
| | T | 41 | −37 | 41 | 16 | 88.1 | 109.0 | 16 | |
| 8-1 | L | 103 | +13 | 68 | 32 | 77.0 | 107.3 | 21 | CR |
| | T | 67 | +29 | 39 | 14 | 78.6 | 108.2 | 18 | |
| 8-2 | L | 90 | +12 | 56 | 20 | 87.2 | 109.7 | 20 | CR |
| | T | 99 | +21 | 54 | 20 | 88.3 | 110.0 | 17 | |
| 8-3 | L | 60 | −44 | 61 | 46.5 | 88.6 | 111.0 | 17 | CR |

TABLE V-continued

| Plate I.D. | Test Direction | Shelf Energy (ft-lbs) | 50% FATT (°C.) | CVN +21.1° C. (ft-lbs) | CVN −28.9° C. (ft-lbs) | Yield Strength (KSI) | Ultimate Tensile Strength (KSI) | % Elongation (8 inch) | Rolling Practice |
|---|---|---|---|---|---|---|---|---|---|
| | T | 45 | −29 | 43 | 25 | 90.8 | 112.0 | 16 | |

It will be seen that the invention provides a new as-hot-rolled plate product which meets the requirements of a high minimum yield strength in combination with high formability, good toughness and weldability. This combination of mechanical properties has been achieved through a carefully controlled composition and processing, including precipitation hardening and controlled-rolling to a precise schedule.

Many variations and modifications of the invention will be apparent to those skilled in the art in view of the foregoing detailed description. Therefore, it is to be understood that, within the scope of the appended claims, the invention can be practiced otherwise than as specifically described.

What is claimed is:

1. A process of making as-hot-rolled steel plate characterized in the hot-rolled condition by a precipitation hardened ferrite-pearlite microstructure, a minimum yield strength of 80 ksi, at least 15 foot-pound Charpy V-notch at a temperature of −30° C., in both longitudinal and transverse sections up to ½ inch in thickness, high formability and good weldability comprising the steps of providing a killed steel consisting essentially in percent by weight of 0.20–0.26 carbon, 1.0–1.7 manganese, up to about 1.5 silicon, up to about 0.04 phosphorous, up to about 0.02 sulfur, 0.08–0.20 vanadium, 0.01–0.09 Al, and at least one of from 0.01 to 0.025 nitrogen and from 0.01 to 0.10 columbium, and the balance iron, heating to a temperature at which sufficient vanadium is dissolved to obtain precipitation hardening with a minimum yield strength of 80 ksi, hot rolling the steel from said temperature to provide at least a 30% reduction in thickness below about 950° C. with no substantial rolling below the $Ar_3$ temperature and cooling the steel at a rate no faster than air cooling.

2. A process as claimed in claim 1 in which said hot rolling step is carried out so that there is no more than 5% hot reduction below the $Ar_3$ temperature.

* * * * *